US006968989B1

(12) United States Patent
Hall, Jr.

(10) Patent No.: US 6,968,989 B1
(45) Date of Patent: Nov. 29, 2005

(54) MANUALLY OPERABLE DEVICE FOR DRIVING NAILS

(76) Inventor: Thomas Hall, Jr., P.O. Box 116, Childs, MD (US) 21916

( * ) Notice: Subject to any disclaimer, the term of this patent is extended or adjusted under 35 U.S.C. 154(b) by 40 days.

(21) Appl. No.: 10/907,109

(22) Filed: Mar. 21, 2005

(51) Int. Cl.[7] ..... B25C 1/04
(52) U.S. Cl. ..... 227/147; 227/156; 173/90
(58) Field of Search ..... 227/147, 156; 173/90, 91, 170, 171

(56) References Cited

U.S. PATENT DOCUMENTS

| | | | | | |
|---|---|---|---|---|---|
| 913,014 | A | | 2/1909 | Kaper | |
| 2,587,944 | A | * | 3/1952 | Williams | 173/115 |
| 2,624,879 | A | | 1/1953 | Baird | |
| 2,759,486 | A | * | 8/1956 | Pesaturo | 135/16 |
| 3,016,964 | A | * | 1/1962 | Schmidt | 173/131 |
| 3,036,482 | A | | 5/1962 | Kenworthy et al. | |
| 3,342,228 | A | * | 9/1967 | Reid | 81/44 |
| 3,711,008 | A | | 1/1973 | Clifford et al. | |
| 3,774,361 | A | * | 11/1973 | Tanner | 52/162 |
| 3,979,040 | A | | 9/1976 | Denin | |
| 4,101,088 | A | * | 7/1978 | Stauth | 242/396.1 |
| 4,120,436 | A | | 10/1978 | Burch | |
| 4,201,258 | A | | 5/1980 | Elmore et al. | |
| 4,241,795 | A | * | 12/1980 | Landry, Jr. | 173/90 |
| 4,252,259 | A | | 2/1981 | Brosius | |
| 4,299,021 | A | | 11/1981 | Williams | |
| 4,316,513 | A | | 2/1982 | Harris | |
| 4,405,005 | A | * | 9/1983 | Zanker | 144/195.5 |
| 4,429,562 | A | | 2/1984 | Hultquist | |
| 4,483,475 | A | | 11/1984 | Whitaker | |
| 4,802,802 | A | | 2/1989 | Thurner | |
| 5,038,665 | A | | 8/1991 | Aske et al. | |
| 5,163,597 | A | * | 11/1992 | Napoli et al. | 227/140 |
| 5,699,864 | A | * | 12/1997 | Dvorak et al. | 173/91 |
| 6,708,585 | B1 | * | 3/2004 | Posenauer | 81/27 |

* cited by examiner

*Primary Examiner*—Scott A. Smith

(57) ABSTRACT

A manually operable device for driving nails into material includes a barrel having a bore into which nails can be placed or dropped and the barrel capable of reaching difficult, narrow, tight spaces that are unreachable by a hammer. Disposed within the bore is a drive rod having a flat face for striking the nail. A handle is connected to the drive rod and is manually reciprocated by the individual thereby transmitting reciprocal motion to the drive rod so that the drive rod can strike and drive the nail into the material. In operation the handle, the drive rod, and nail are axially aligned thus maximizing the striking force of the drive rod against the nail. A safety cable has one end secured to the handle and a second end secured to the barrel for attaching the device to the worker's belt or apron for easy retrieval and to prevent the device from being dropped; and the safety cable's length allows for back loading as well as front loading of nails into the barrel.

3 Claims, 5 Drawing Sheets

MANUALLY OPERABLE DEVICE FOR DRIVING NAILS

The present invention pertains to pneumatic, hydraulic and manually operable devices for driving fasteners, such as nails, into material substrates like wood, plastic, metal or concrete, and more particularly pertains to a hand operable nail driving device that maintains the position and alignment of the nails for driving the nails into tight, narrow spaces that are generally unreachable with conventional hammers.

SUMMARY OF THE INVENTION

The use of nails and other types of fasteners to secure and fix in place structural elements such as wooden beams, paneling, roof shingles and concrete framework is ubiquitous in both the private and commercial building and construction fields. Driving nails and other types of fasteners into material substrates is relatively easy when the area is flat, open and unobstructed such as an expanse of roof or the sidewall of a large commercial building.

However, there are countless instances where nails and other types of fasteners must be infixed in locations and spaces that are tight, narrow, awkward to reach or obstructed by, for example, plumbing conduit, electrical lines, engines, compressors, HVAC equipment and lines and the like. In such cases a conventional hammer is of no use because the narrow, constricted area inhibits or completely prevents the individual from utilizing the full accurate swinging or striking motion of the hammer to drive in the nail. Even if the individual is able to employ a reduced striking motion, the force produced by such an attenuated hammer stroke may be wholly ineffectual for driving in the nail. One of the most difficult nailing situations involves form work for building structures, especially concrete form work, where the nailing situations involve nearly impossible angles and orientations and dangerous climbing and work several stories above the ground.

In view of the above difficulties of driving nails in tight, narrow spaces, and the attendant difficulty of aligning and maintaining the nail in the appropriate position prior to infixing the nail in the substrate, a number of devices have been conceived to facilitate the process of nail emplacement.

For example, the Kafer patent (U.S. Pat. No. 913,014) discloses a staple driver that includes a handle having a lower threaded portion for securement to a pipe and a rod extending from the handle is receivable within the pipe for driving in staples.

The Baird patent (U.S. Pat. No. 2,624,879) discloses a nail driver that includes a magnetized handle that is attracted to a magnetic handle on the inner end of the tube for holding both elements together.

The Kenworthy et al. patent (U.S. Pat. No. 3,036,482) discloses an axial-impact type hand tool that includes several types of detachable heads for the end of the tube that are secured to the end of the tube by a detent.

The Clifford et al. patent (U.S. Pat. No. 3,711,008) discloses impact tools that are both manually and pneumatically operated.

The Denin patent (U.S. Pat. No. 3,979,040) discloses a nail driver that includes a tube having a magnetic holder adjacent its outer end for holding the nail in place at the end of the tube.

The Litch patent (U.S. Pat. No. 4,120,438) discloses a nail driver that includes a housing for receiving a rod that has a magnetized end for holding the nail in place and a weighted, spring-assisted handle for enhancing the drive force of the rod.

Elmore et al. (U.S. Pat. No. 4,201,258) discloses a nail holder having pivotable jaws capable of holding a nail in an opening formed by the closure of the jaws. The distal ends of the jaws include grooves for holding small diameter fasteners and at least one jaw has measuring indicia marked thereon.

The Rix patent (U.S. Pat. No. 4,221,248) discloses a nail holder for fastening nails into corrugated roofing and includes a pair of pivotable jaws for gripping the nail and structure adapted to receive a portion of the roofing whereupon a hammer can be used to strike the nail and drive the nail into the roofing.

The Brosius patent (U.S. Pat. No. 4,252,259) discloses a low velocity impact or hammer drive tool for driving in fasteners, and employs a firing pin assembly and powder charge to actuate an anvil-type structure for striking and driving in fasteners.

The Williams patent (U.S. Pat. No. 4,299,021) discloses an axial impact tool that includes a magnetic tip threaded onto the end of the impact rod and a penlight that is mountable to the guide tube.

The Harris patent (U.S. Pat. No. 4,316,513) discloses an impact hammer for use in mines and includes an internally reciprocating ram that strikes an anvil that, in turn, drives the nail into the mine wall.

The Hultquist patent (U.S. Pat. No. 4,429,562) discloses an auto body dent remover and puller and includes a shank that is inserted into a drilled hole or an existing hole in the auto body.

The Whitaker patent (U.S. Pat. No. 4,483,475) discloses a nail driver that includes a reversible guide tube for fitting onto a plunger rod with the travel of the rod delimited by an annular finger guard on the lower end of the handle from which the rod extends, and an annular flange on one end of the guide tube.

The Thurner device (U.S. Pat. No. 4,802,802) discloses an integral flange and sleeve structure fitted to a nail and which is passed through an opening so that striking the nail causes the sleeve to squash or flatten about the opening thereby securing the integral flange and sleeve structure, and the nail, in position.

The Aske et al. device (U.S. Pat. No. 5,038,665) discloses a propellant operated, single shot stud gun for driving fasteners into bridges and building structures.

While the above devices display a range of ingenuity they are not adaptable or usable for driving nails in tight, narrow, hard to reach spaces and locations. Therefore, there is a need for a simple, manually operable nail driving device that can be easily and quickly maneuvered into tight, narrow spaces for aligning and driving nails into various surfaces and substrates.

BACKGROUND OF THE INVENTION

The present invention comprehends a manually operable device for driving in fasteners in tight, difficult to reach locations that are unreachable by a hammer.

The manually operable device includes a cylindrical, elongated barrel having an inner end and an opposite surface contact end. A bore extends through the barrel from the inner end to the surface contact end. Disposed within the barrel is an elongated drive rod. The drive rod has an attachment end and an opposite working or fastener contact end, and the drive rod is capable of linear reciprocal movement within the barrel so that the fastener contact end can successively strike the fastener for infixing the fastener to and in the material. Connected to the attachment end of the drive rod, and extending externally from the barrel, is a handle that is grasped by the individual for back and forth motion. The handle is connected in axial alignment with the drive rod so that the line of motion of the handle is concomitant with the reciprocal movement of the drive rod. In addition, a safety cable attaches the barrel to the handle, and includes a clip for securing the device to the worker's belt or apron for easy retrieval and to prevent the device from being dropped and injuring a worker on a lower level. Moreover, the safety cable is of sufficient length to permit both the front loading and the back loading of nails into the barrel without detaching the barrel from the handle.

It is an objective of the present invention to provide a manually operable device for driving nails that is lightweight, portable and easy to operate.

It is another objective of the present invention to provide a manually operable device for driving nails that is highly maneuverable in order to reach narrow, tight locations.

It is still yet another objective of the present invention to provide a manually operable device for driving nails that is attachable to the belt, apron or other article of clothing of the worker thereby having the device readily available and avoiding the need to constantly retrieve the device;

It is still yet a further objective of the present invention to provide a manually operable device for driving nails that allows for the front-loading and the rear loading of the nails into the substrate;

Yet another objective of the present invention is to provide a manually operable device capable of driving in nails of various sizes and configurations.

Still another objective of the present invention is to provide a manually operable device capable of driving 4, 6, 8, 10 and 16 penny nails into various kinds of material including wood, metal and plastic.

Still yet another objective of the present invention is to provide a manually operable device capable of providing sufficient driving force for infixing nails into concrete framework.

These and other objects, features and advantages will become apparent to those skilled in the art upon a perusal of the following detailed description and the accompanying drawings.

DETAILED DESCRIPTION OF THE PREFERRED EMBODIMENT

Figure 1:
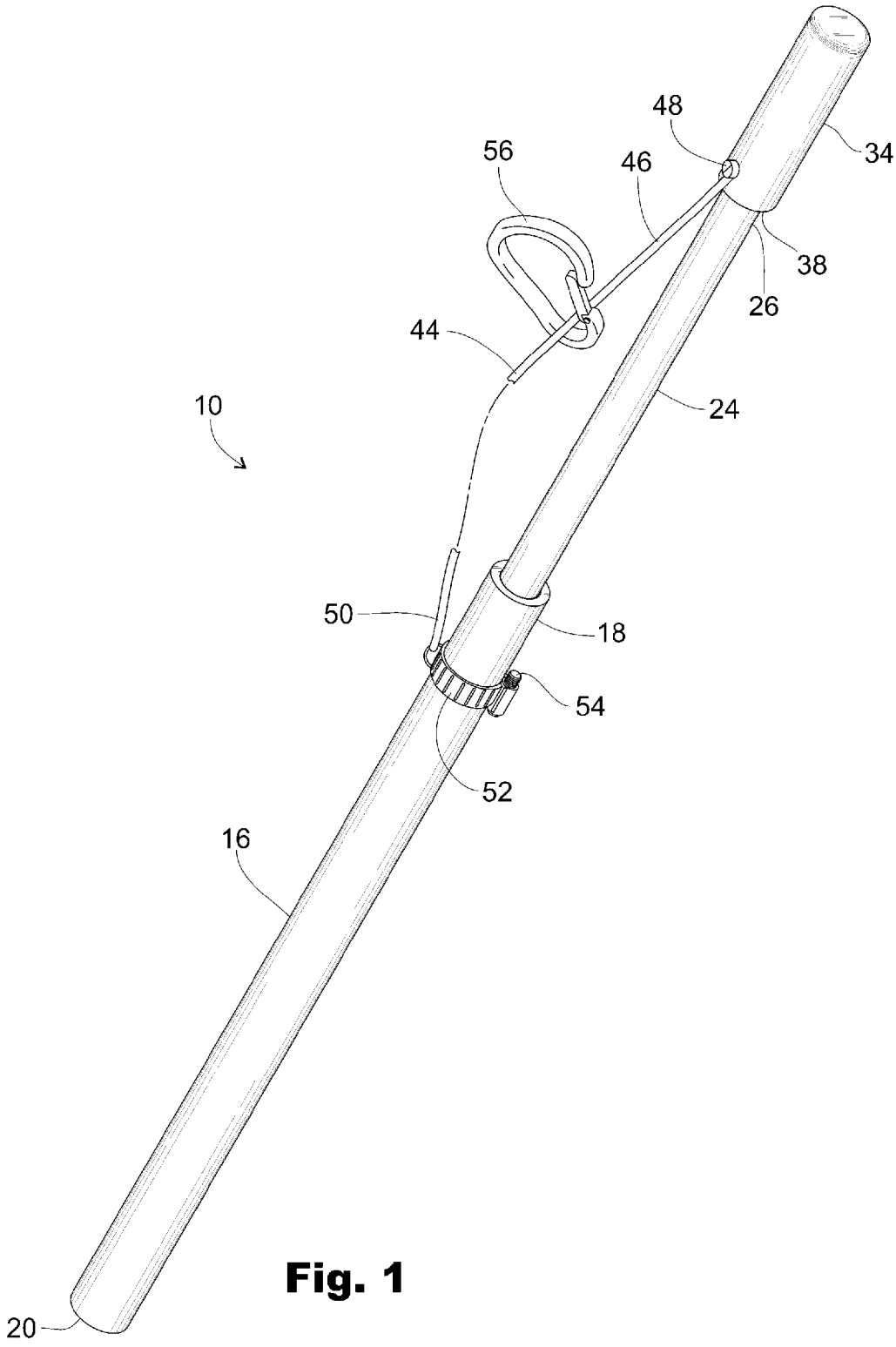
FIG. 1 is a perspective view of the manually operable nail driver of the present invention illustrating the disposition of the drive rod in the pre-striking position relative to the barrel and the safety cable that connects the drive rod to the barrel and also for allowing the attachment of the nail driver to the worker's belt or work apron.

Illustrated in FIGS. 1–6 is a manually operable device 10 for driving fasteners, such as nails 12, into a substrate, surface or material 14 such as wood, metal, plastic or concrete framework. The device 10 of the present invention is slender, lightweight, rugged and highly maneuverable for reaching awkward and difficult locations and for use in narrow, tight spaces that are unreachable by a hammer or that prevent the individual from achieving an adequate range of striking motion for the hammer.

As shown in FIGS. 1–5, the manually operable device 10 includes a slender, cylindrical, elongated barrel 16 that has an inner end 18 and an opposite surface contact or engagement end 20. The surface contact end 20 of the barrel 16 is flat so that the surface contact end 20 can be placed contiguous to the material 14 in which the nail 12 is to be driven. The barrel 16 also includes a cylindrical bore 22 that extends from the inner end 18 to the surface contact end 20. The barrel 16 is preferably composed of a heavy walled galvanized pipe.

The manually operable device 10 includes a drive rod 24, as illustrated in FIGS. 1–5, that is the moving and working element for successively striking the nail 12 in order to infix the nail 12 into the material 14. The drive rod 24 is elongated and cylindrical-shaped for disposition within the bore 22 and is manually actuated by the individual for slidable, reciprocal movement therein. The drive rod 24 of the present invention is generally coequal in length with the barrel 16 and is axially aligned with the barrel 16. The drive rod 24 includes a handle connection end 26 and an opposite interior working end 28, and the drive rod 24 is preferably a round steel rod. The interior working end 28 has a flat face 30 for contacting the nail head 32 and driving the nail 12 into the material 14.

As shown in FIGS. 1–5, the device 10 includes a cylindrical handle 34 that is attached to the handle connection end 26; and, more specifically, the handle 34 includes a tapped and threaded blind hole 36 that facilitates securement of the handle 34 to the handle connection end 26 of the drive rod 24. The handle 34 and the drive rod 24 can be integrally formed or joined as one unit in an alternative structure. When the device 10 is fully assembled, the handle 34 and the drive rod 24 are disposed in axial alignment with the barrel 16. The handle 34 of FIGS. 1–5 has the same outside diameter as the barrel 16 and includes an annular abutment surface 38 that impinges the inner end 18 of the barrel 16 during the back and forth movement of the handle 34 thereby delimiting the travel of the handle 34 and preventing the handle 34 from physically entering the bore 22. The handle 34 is also preferably manufactured from a durable steel material.

Figure 6:
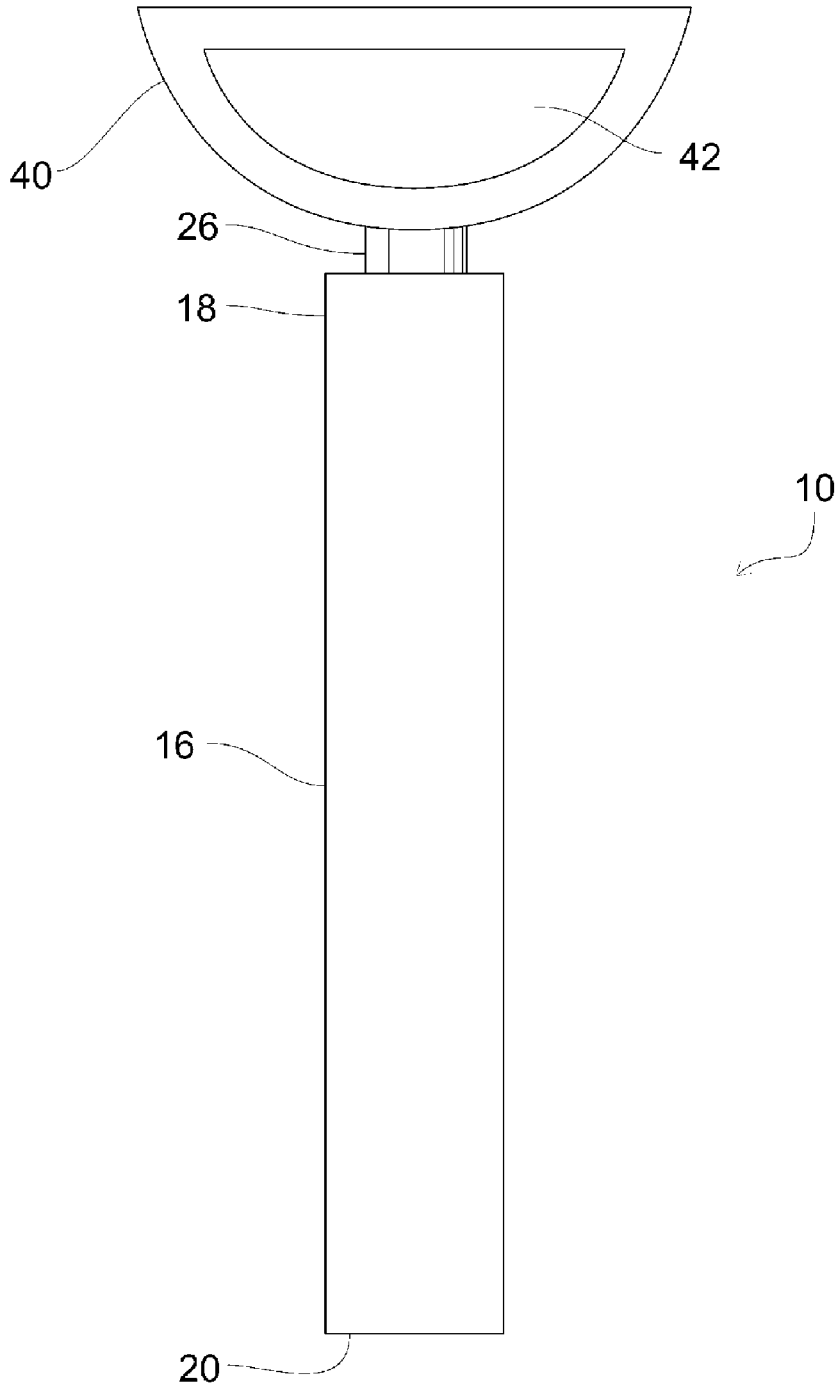
FIG. 6 is a front elevational view of the manually operable nail driver illustrating an alternative design for the handle that is shown in FIGS. 1–5.

FIG. 6 illustrates an alternative embodiment for the handle 34 that is a semicircular-shaped or half-moon accurate shaped handle 40 similar to the handle of the saw. The handle 40 of FIG. 6 includes an aperture or hand opening 42 through which the individual can insert his hand for gripping the handle 40. The handle 40 of the device 10 could, in fact, include a range of geometric shapes such as a circle or parallelogram to enhance the ease with which the handle 34 or 40 can be gripped and held. The handle 40 of FIG. 6 may be more ergonomically designed than the handle 34 of FIGS.

1–5 for maximizing the striking force of the drive rod 24. Thus, the motion of the individual's arm would be closer or coincident to the line of action of the drive rod 24 when reciprocating the handle 40 of FIG. 6; whereas the motion of the individual's arm would be slightly at angle to the line of action of the drive rod 24 when reciprocating the handle 34 of FIGS. 1–5.

Figure 2:
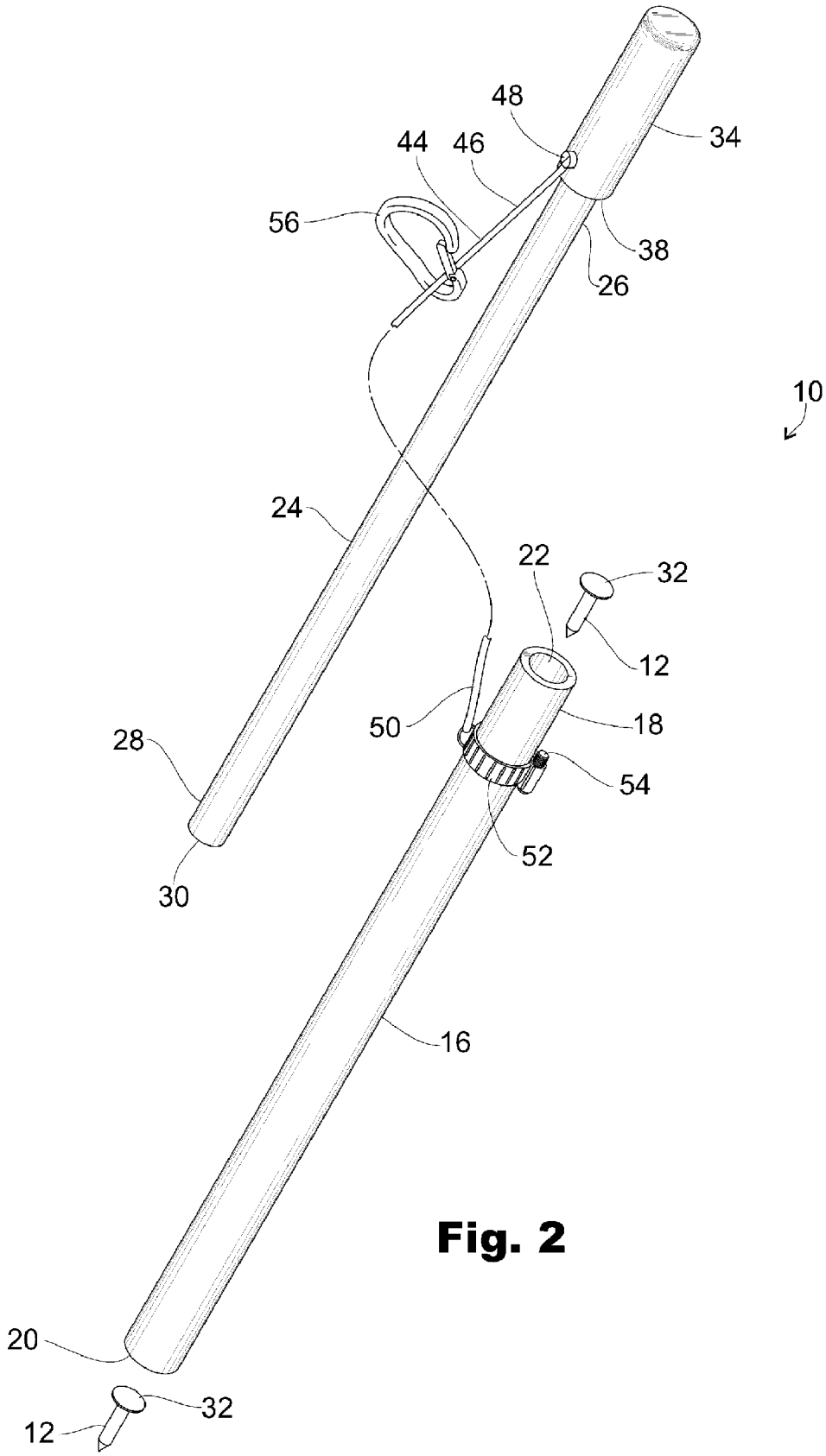
FIG. 2 is an exploded isometric view of the manually operable nail driver illustrating the ability to either front load or rear load nails into the barrel of the nail driver.
Figure 3:
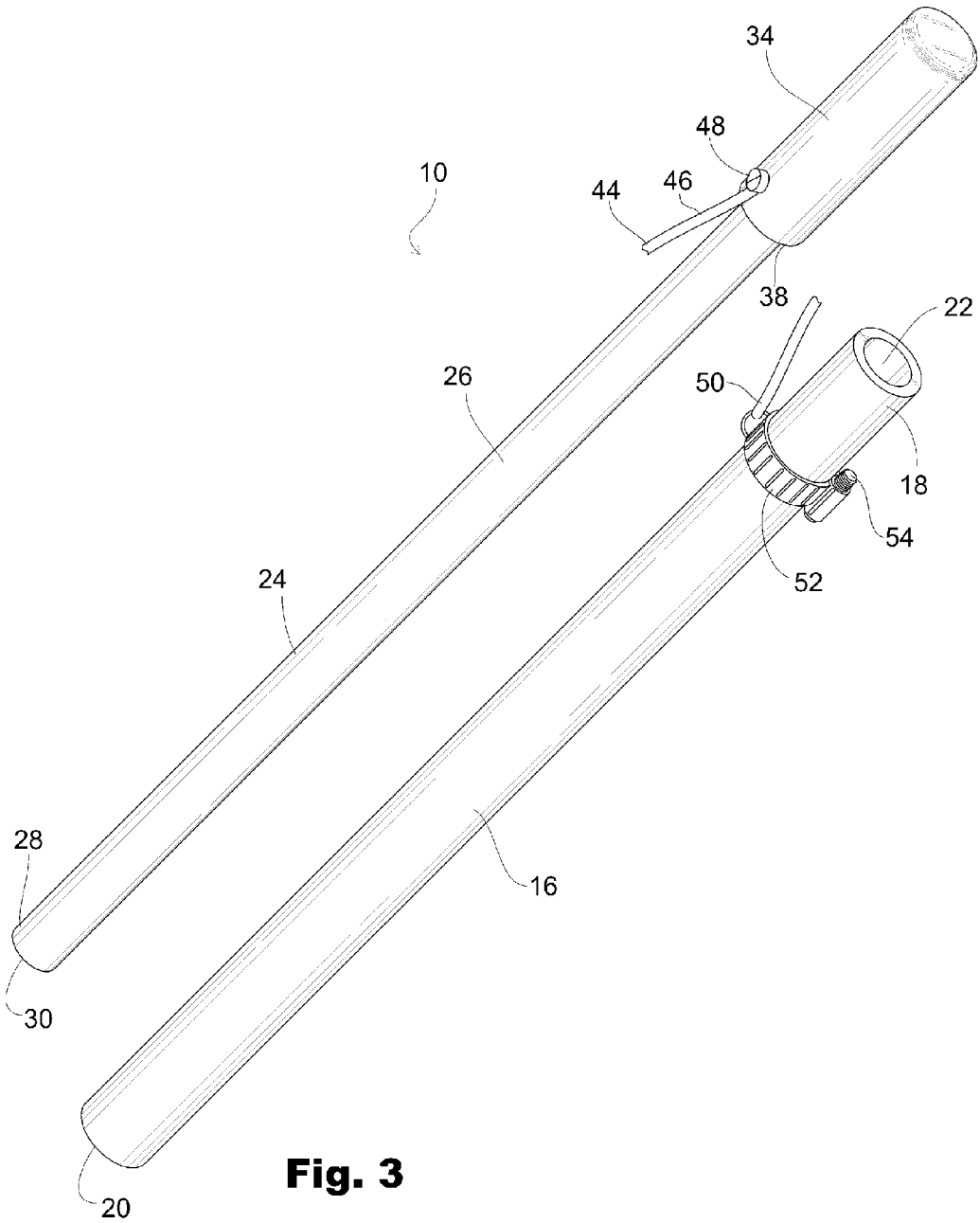
FIG. 3 is an exploded isometric view of the manually operable nail driver of the present invention.
Figure 4:
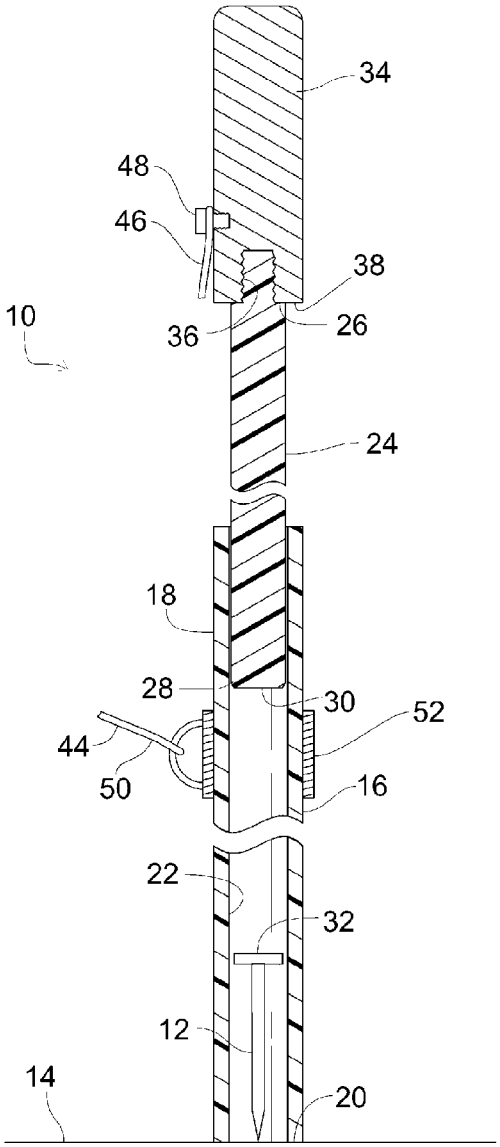
FIG. 4 is a side elevational view of the manually operable nail driver illustrating the disposition of the nail and the drive rod prior to the nail being infixed into the material by the action of the drive rod.
Figure 5:
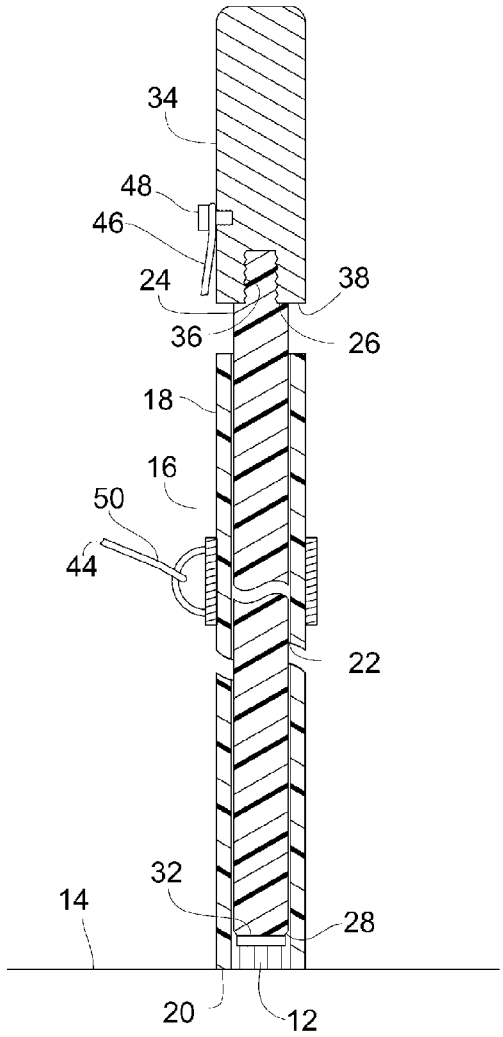
FIG. 5 is a side elevational view of the manually operable nail driver illustrating the drive rod striking the nail for infixing the nail into the material.

In addition, as shown in FIGS. 1–5, the device 10 includes a flexible safety cable 44 having a first end 46 attached to the handle 34 by a screw 48 inserted into a tapped hole extending into the body of the handle 34. The cable 44 has a second end 50 that is attached to a clamp 52, such as a stainless steel pipe clamp, with clamp 52 being securely mounted to the inner end 18 of the barrel 16. The clamp 52 is tightened against the barrel 16 and can be loosened for slidable adjustment along the length of the barrel 16 by turning adjustment screw 54. By adjusting the position of the clamp 52 on the barrel 16, the worker can adjust the slackness or tautness of the safety cable 44, as well as accommodate safety cables of different lengths. A fastening device, such as a snap hook or spring clip 56, is secured to the safety cable 44 and is freely slidable along the length of the safety cable 44. The spring clip 56 is attachable to, and easily detachable from, for example, the worker's belt or work apron. Thus, the device 10 is attachable to the worker's clothing, and this provides for the easy location and retrieval of the device 10 when needed; the worker doesn't need to constantly set the device 10 down and then search about to retrieve it when needed. Moreover, the safety cable 44 also provides a measure of safety in so far as attaching the device 10 to the worker's clothing by the spring clip 56 prevents the device 10 from accidentally being dropped on and injuring workers stationed on the ground or on lower levels. Furthermore, the safety cable 44 is of sufficient length to allow the withdrawal of the drive rod 24 from the inner end 18 of the barrel 16 while still maintaining the connection of the safety cable 44 to the handle 34 and the barrel 16. This provides the worker with the flexibility to either back load the nail 12 into the inner end 18 of the barrel 16, or front load the nail 12 into the surface contact end 20 of the barrel 16, as shown in FIG. 2, to more easily and efficiently accommodate the device 10 to the wide range of nailing situations that may be encountered. In back loading the nail 12 the worker would simply withdraw the drive rod 24 backward or rearward from the inner end 18 of the barrel 16 until the working end 28 of the drive rod 24 completely clears the inner end 18. The safety cable 44 would be of sufficient length to still maintain the connection of the handle 34 to the barrel 16. Then the worker would insert the nail 12 into the bore 22 of the barrel 16 at the inner end 18, and then re-insert the drive rod 24 and the device 10 would be ready for nail driving.

With reference to FIGS. 1–6, in using the device 10 the worker could first set the nail 12 in position if the location were an overhead location. Alternatively, with the drive rod 24 withdrawn from the barrel 16 as above described, the barrel 16 could be placed on the location with the surface contact end 20 against the material 14 and the nail 12 could be back loaded into the barrel 16. Back loading the nail 12 into the bore 22 of the barrel 16 assists in both the alignment of the nail 12 and further maintains the nail 12 in the appropriate position to facilitate its emplacement into the material 14. The drive rod 24 would then be slid back into the barrel 16 at the inner end 18. The worker would then grasp the handle 34 or 40 and reciprocate the handle 34 or 40 thereby transmitting linear motion to the drive rod 24 and causing the flat face 30 at the interior working end 28 of the drive rod 24 to repeatedly strike the nail 12 until the nail 12 is driven into the material 14 to the desired depth. The worker may need to strike the nail 12 only once or numerous times to drive and secure the nail 12 into the material 14. Upon securely driving the nail 12 into the material 14, the barrel 16 can be simply removed or lifted from its engagement against the material 14 so that the worker can continue the nailing operation along the form work, for example; or the worker can reattach the device 10 to his apron or belt by the spring clip 56 and then move to another location or ascend or descend to different levels adjacent or on the building structure for further nail driving and placement.

The foregoing description discloses and describes a preferred embodiment for the invention, and those skilled in the art will understand that other variations and modifications may be possible and practicable, and still come within the ambit of the invention and the scope of the appended claims.

What is claimed is:

1. A manually operable device for driving a nail into a substrate, comprising:

an elongated barrel having an inner end and an opposite surface contact end, and a bore extending from the inner end to the surface contact end;

an elongated drive rod disposed within the bore of the barrel and capable of linear reciprocal movement within the barrel;

the drive rod having an interior working end for striking the nail so that the nail can be driven into the substrate;

a handle attached to the drive rod and extending from the inner end of the barrel;

a safety cable having a first end secured to the handle and the second end secured to the barrel adjacent the inner end thereof;

a spring clip attached to and freely slidable along the length of the safety cable, the spring clip capable of attachment to and detachment from a clothing article of a worker so that the device can be attached to the clothing article for retrieval therefrom;

the safety cable having a length sufficient to allow the drive rod to be withdrawn from the inner end of the barrel with the safety cable securable to the handle and barrel so that the nail can be back loaded into the inner end of the barrel; and the handle attached to the drive rod and extending rearward from the inner end of the barrel so a reciprocal back and forth motion exerted on the handle is transmitted to the drive rod for reciprocating the drive rod and driving the nail into the substrate.

2. The device for driving in nails of claim 1 wherein the handle includes a semi-circular arcuate shape and defines an opening so that a hand of an individual can be inserted therethrough for grasping and holding the handle while driving in the nail.

3. Apparatus for driving fasteners into a material, comprising:

an elongated barrel having an inner end and an opposite surface contact end, and a bore extending through the barrel from the inner end to the surface contact end;

an elongated drive rod disposed within the bore for linear reciprocal movement therein in order to successively strike the fasteners and drive the fasteners into the material;

the drive rod having an inner working end for striking the fasteners and driving the fasteners into the material;

a handle mounted to the drive rod and extending rearward from the inner end of the barrel when the drive rod is disposed within the bore;

a flexible safety cable having a first end secured to the handle and a second end secured to the barrel adjacent the inner end thereof;

a snap hook mounted to the safety cable and freely slidable therealong, the snap hook removably attachable to an article of clothing of a worker so that the apparatus can be attached to the clothing article and easily retrieved therefrom for driving fasteners;

the safety cable having a length sufficient to allow the drive rod to be withdrawn rearward from the inner end of the barrel with the safety cable still connecting the handle to the barrel so that fasteners can be back loaded into the inner end of the barrel; and the handle having an arcuate shape mounted to the drive rod and projecting externally from the barrel whereupon the manually actuated reciprocal motion of the handle is communicated to the drive rod causing the drive rod to successively strike the fasteners and drive the fasteners into the material.

* * * * *